US008009841B2

(12) United States Patent
Christoph

(10) Patent No.: US 8,009,841 B2
(45) Date of Patent: Aug. 30, 2011

(54) HANDSFREE COMMUNICATION SYSTEM

(75) Inventor: Markus Christoph, Staubing (DE)

(73) Assignee: Nuance Communications, Inc., Burlington, MA (US)

( * ) Notice: Subject to any disclaimer, the term of this patent is extended or adjusted under 35 U.S.C. 154(b) by 1244 days.

(21) Appl. No.: 11/701,629

(22) Filed: Feb. 2, 2007

(65) Prior Publication Data

US 2007/0172079 A1 Jul. 26, 2007

Related U.S. Application Data

(63) Continuation-in-part of application No. 10/563,072, filed on Aug. 23, 2006, now Pat. No. 7,826,623.

(30) Foreign Application Priority Data

Jun. 30, 2003 (EP) ..... 03014846

(51) Int. Cl.
*H04R 3/00* (2006.01)

(52) U.S. Cl. ..... 381/92; 381/91; 381/122; 367/118; 367/119

(58) Field of Classification Search ..... 381/91–92, 381/122; 367/118–119; 704/226, 233
See application file for complete search history.

(56) References Cited

U.S. PATENT DOCUMENTS

| | | | | |
|---|---|---|---|---|
| 4,696,043 | A * | 9/1987 | Iwahara et al. | 381/92 |
| 5,659,619 | A | 8/1997 | Abel | |
| 5,715,319 | A | 2/1998 | Chu | |
| 5,727,074 | A * | 3/1998 | Hildebrand | 381/103 |
| 6,339,758 | B1 * | 1/2002 | Kanazawa et al. | 704/226 |
| 6,507,659 | B1 * | 1/2003 | Iredale et al. | 381/26 |
| 6,549,627 | B1 | 4/2003 | Rasmusson et al. | |
| 6,594,367 | B1 | 7/2003 | Marash et al. | |
| 6,748,088 | B1 | 6/2004 | Schaaf | |
| 6,836,243 | B2 | 12/2004 | Kajala et al. | 342/377 |
| 7,076,072 | B2 * | 7/2006 | Feng et al. | 381/313 |
| 7,158,643 | B2 | 1/2007 | Lavoie et al. | |
| 2003/0063759 | A1 * | 4/2003 | Brennan et al. | 381/92 |
| 2003/0072464 | A1 | 4/2003 | Kates | 381/312 |
| 2004/0120532 | A1 * | 6/2004 | Dedieu et al. | 381/92 |
| 2005/0232441 | A1 * | 10/2005 | Beaucoup et al. | 381/92 |
| 2006/0233392 | A1 * | 10/2006 | Koyanagi | 381/98 |

FOREIGN PATENT DOCUMENTS

WO WO 01/87011 A2 11/2001

OTHER PUBLICATIONS

Su, et al. "Performance Analysis of MVDR Algorithm in the Presence of Amplitude and Phase Errors", pp. 796-800, IEEE 2001.

* cited by examiner

*Primary Examiner* — Devona E Faulk
*Assistant Examiner* — Disler Paul
(74) *Attorney, Agent, or Firm* — Sunstein Kann Murphy & Timbers LLP

(57) ABSTRACT

A handsfree communication system includes microphones, a beamformer, and filters. The microphones are spaced apart and are capable of receiving acoustic signals. The beamformer compensates for propagation delays between the direct and reflected acoustic signals. The filters are configured to a predetermined susceptibility level. The filter process the output of the beamformer to enhance the quality of the received signals.

5 Claims, 13 Drawing Sheets

HANDSFREE COMMUNICATION SYSTEM

PRIORITY CLAIM

This application is a continuation-in-part of U.S. application Ser. No. 10/563,072 which has a 371(c) date of Aug. 23, 2006 now U.S. Pat. No. 7,826,623, which claims the benefit of priority from European Patent Application No. 03014846.4, filed Jun. 30, 2003 and PCT Application No. PCT/EP2004/007110, filed Jun. 30, 2004, all of which are incorporated herein by reference.

BACKGROUND OF THE INVENTION

1. Technical Field

This application is directed towards a communication system, and in particular to a handsfree communication system.

2. Related Art

Some handsfree communication systems process signals received from an array of sensors through filtering. In some systems, delay and weighting circuitry is used. The outputs of the circuitry are processed by a signal processor. The signal processor may perform adaptive beamforming, and/or adaptive noise reduction. Some processing methods are adaptive methods that adapt processing parameters. Adaptive processing methods may be costly to implement and can require large amounts of memory and computing power. Additionally, some processing may produce poor directional characteristics at low frequencies. Therefore, a need exists for a handsfree cost effective communication system having good acoustic properties.

SUMMARY

A handsfree communication system includes microphones, a beamformer, and filters. The microphones are spaced apart and are capable of receiving acoustic signals. The beamformer may compensate for the propagation delay between a direct and a reflected signal. The filters use predetermined susceptibility levels, to enhance the quality of the acoustic signals.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A handsfree communication device may include a superdirective beamformer to process signals received by an array of input devices spaced apart from one another. The signals received by the array of input devices may include signals directly received by one or more of the input devices or signals reflected from a nearby surface. The superdirective beamformer may include beamsteering logic and one or more filters. The beamsteering logic may compensate for a propagation time of the different signals received at one or more of the input devices. Signals received by the one or more filters may be scaled according to respective filter coefficients.

Figure 2:
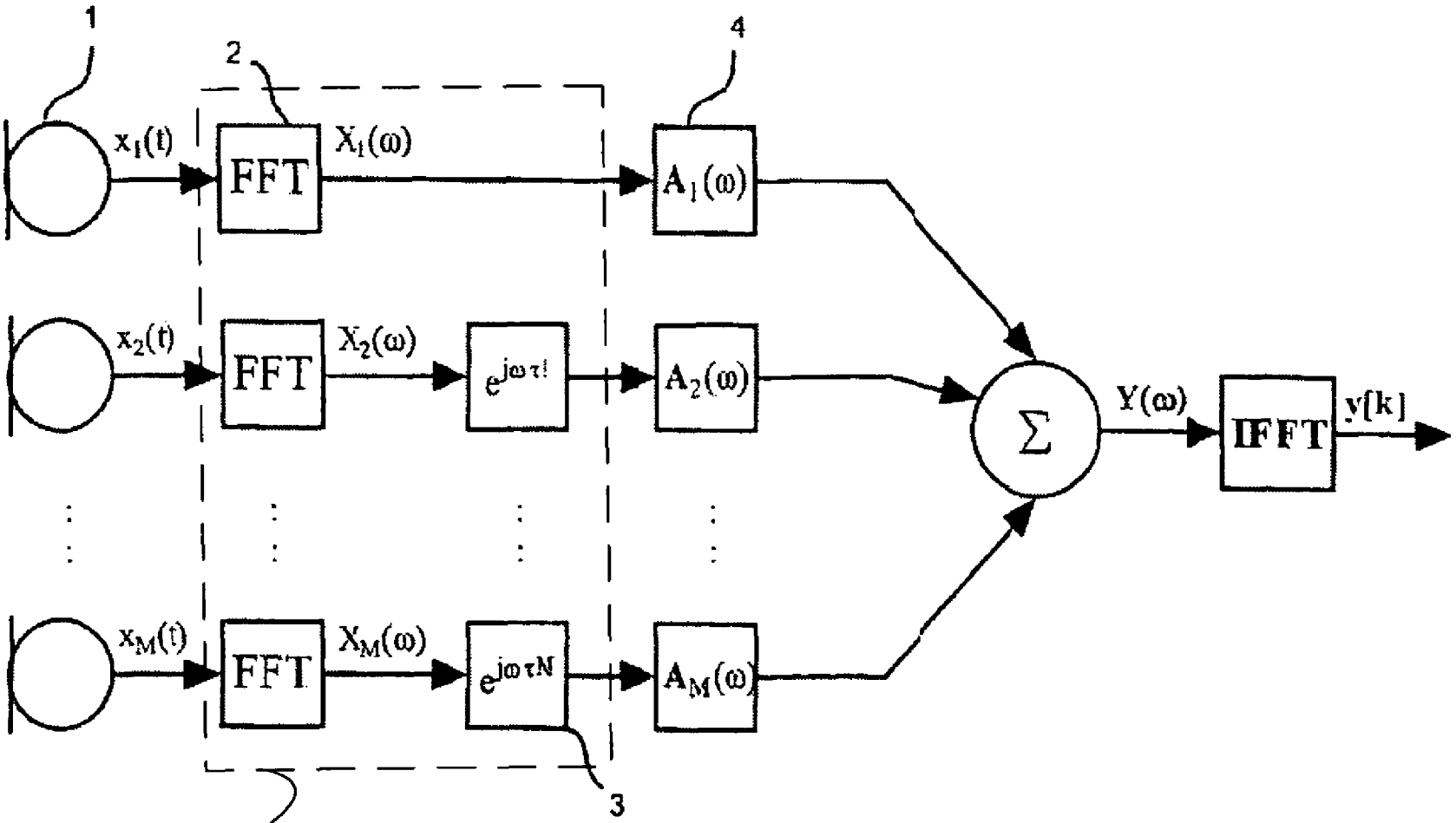
FIG. 2 is a schematic of a beamformer using frequency domain filters.

For a filter that operates on a frequency dependent signal, such as those shown in FIG. 2 and identified by reference number 4, optimal filter coefficients $A_i(\omega)$ may be computed according to $$A_i(\omega) = \frac{\Gamma(\omega)^{-1} d(\omega)}{d(\omega)^H \Gamma(\omega)^{-1} d(\omega)},$$

where the superscript H denotes Hermitian transposing and $\Gamma(\omega)$ is the complex coherence matrix $$\Gamma(\omega) = \begin{pmatrix} 1 & \Gamma x_1 x_2(\omega) & \cdots & \Gamma x_1 x_M(\omega) \\ \Gamma x_2 x_1 & 1 & \cdots & \Gamma x_2 x_M(\omega) \\ \vdots & \vdots & \ddots & \vdots \\ \Gamma x_M x_1(\omega) & \Gamma x_M x_2(\omega) & \cdots & 1 \end{pmatrix}.$$

The entries of the coherence matrix are the coherence functions that are the normalized cross-power spectral density of two signals $$\Gamma x_1 x_{ji}(\omega) = \frac{P x_1 x_j(\omega)}{\sqrt{P x_1 x_i(\omega) P x_j x_j(\omega)}}.$$

By separating the beamsteering from the filtering process, the steering vector $d(\omega)$ in the filter coefficient equation, $A_i(\omega)$, may be reduced to the unity vector $d(\omega)=(1, 1, \ldots, 1)^T$, where the superscript T denotes transposing. Furthermore, in the isotropic noise field in three dimensions (diffuse noise field), the coherence may be given by $$\Gamma x_1 x_1(\omega) = si\left(\frac{2\pi f d_{if}}{c}\right) e^{-j\frac{2\pi f d_{ij} \cos\Theta_0}{c}},$$

$$\text{with } si(x) = \frac{\sin x}{x}$$

and where $d_{if}$ denotes the distance between microphones i and j in the microphone array, and $\Theta_0$ is the angle of the main receiving direction of the microphone array or the beamformer.

The relationship for computing the optimal filter coefficients $A_i(\omega)$ for a homogenous diffuse noise field described above is based on the assumption that devices that convert sound waves into electrical signals such as microphones are perfectly matched, e.g. point-like microphones having exactly the same transfer function. In some systems, a regularized filter design may be used to adjust the filter coefficients. To achieve this, a scalar, such as a regularization parameter μ, may be added at the main diagonal of the cross-correlation matrix. A mathematically equivalent version may be obtained by dividing each non-diagonal element of the coherence matrix by (1+μ), giving:

$$\overline{\Gamma x_1 x_j(\omega)} = \frac{\Gamma x_1 x_j(\omega)}{1+\mu} = \frac{si\left(\frac{2 f d_{if}}{c}\right)}{1+\mu} e^{-j\frac{2\pi f d_{if} \cos\Theta_0}{c}}, \forall\, i \neq j.$$

Alternatively, the regularization parameter μ may be introduced into the equation for computing the filter coefficients:

$$A_i(\omega) = \frac{(\Gamma(\omega) + \mu I)^{-1} d}{d^T (\Gamma(\omega) + \mu I)^{-1} d}$$

where I comprises the unity matrix. In a second approach the regularization parameter may be part of the filter equation. Either approach is equally suitable.

A microphone array may have some characteristic quantities. The directional diagram or response pattern $\Psi(\omega,\Theta)$ of a microphone array may characterize the sensitivity of the array as a function of the direction of incidence Θ for different frequencies. The directivity of an array comprises the gain that does not depend on the angle of incidence Θ. The gain may be the sensitivity of the array in a main direction of incidence with respect to the sensitivity for omnidirectional incidence. The Front-To-Back-Ratio (FBR) indicates the sensitivity in front of the array as compared to behind the array. The white noise gain (WNG) describes the ability of an array to suppress uncorrelated noise, such as the inherent noise of the microphones. The inverse of the white noise gain comprises the susceptibility $K(\omega)$:

$$K(\omega) = \frac{1}{WNG(\omega)} = \frac{A(\omega)^H A(\omega)}{|A(\omega)^H d(\omega)|}.$$

The susceptibility $K(\omega)$ describes an array's sensitivity to defective parameters. In some systems, it is preferred that the susceptibility $K(\omega)$ of the array's filters $A_i(\omega)$ not exceed an upper bound $K_{max}(\omega)$. The selection of this upper bound may be dependent on the relative error $\Delta^2(\omega,\Theta)$ of the array's microphones and/or on the requirements regarding the directional diagram $\Psi(\omega,\Theta)$. The relative error $\Delta^2(\omega,\Theta)$, may comprise the sum of the mean square error of the transfer properties of all microphones $\epsilon^2(\omega,\Theta)$ and the Gaussian error with zero mean of the microphone positions $\delta^2(\omega)$. Defective array parameters may also disturb the ideal directional diagram. The corresponding error may be given by $\Delta^2(\omega, \Theta)K(\omega)$. If it is required that the deviations in the directional diagram not exceed an upper bound of $\Delta\Psi_{max}(\omega,\Theta)$, then the maximum susceptibility may be given by:

$$K_{max}(\omega, \Theta) = \frac{\Delta\Psi_{max}(\omega, \Theta)}{\varepsilon^2(\omega, \Theta) + \delta^2(\omega)}.$$

In many systems, the dependence on the angle Θ may be neglected.

The error in the microphone transfer functions $\epsilon(\omega)$ may have a higher influence on the maximum susceptibility $K_{max}(\omega)$, and on the maximum possible gain $G(\omega)$, than the error $\delta^2(\omega)$ in the microphone positions. In some systems, the defective transfer functions are mainly responsible for the limitation of the maximum susceptibility.

Mechanical precision may reduce some position deviations of the microphones up to a certain point. In some systems, the microphones are modeled as a point-like element, which may not be true in some circumstances. In some systems, positioning errors $\delta^2(\omega)$ may be reduced, even if a higher mechanical precision could be achieved. For example, one system may set $\delta^2(\omega)$=1%. The error $\epsilon(\omega)$ may be derived from the frequency depending deviations of the microphone transfer functions.

To compensate for some errors, inverse filters may be used to adjust the individual microphone transfer functions to a reference transfer function. Such a reference transfer function may comprise the mean of some or all measured transfer functions. Alternatively, the reference transfer function may be the transfer function of one microphone out of a microphone array. In this situation, M−1 inverse filters (M being the number of microphones) are to be computed and implemented.

In some systems, the transfer functions may not have a minimal phase, thus, a direct inversion may produce instable filters. In some systems, only the minimum phase part of the transfer function resulting in a phase error or the ideal non-minimum phase filter is inverted. After computing the inverse filters, they may be coupled with the filters of the beamformer such that in the end only one filter per viewing direction and microphone is required.

Figure 1:
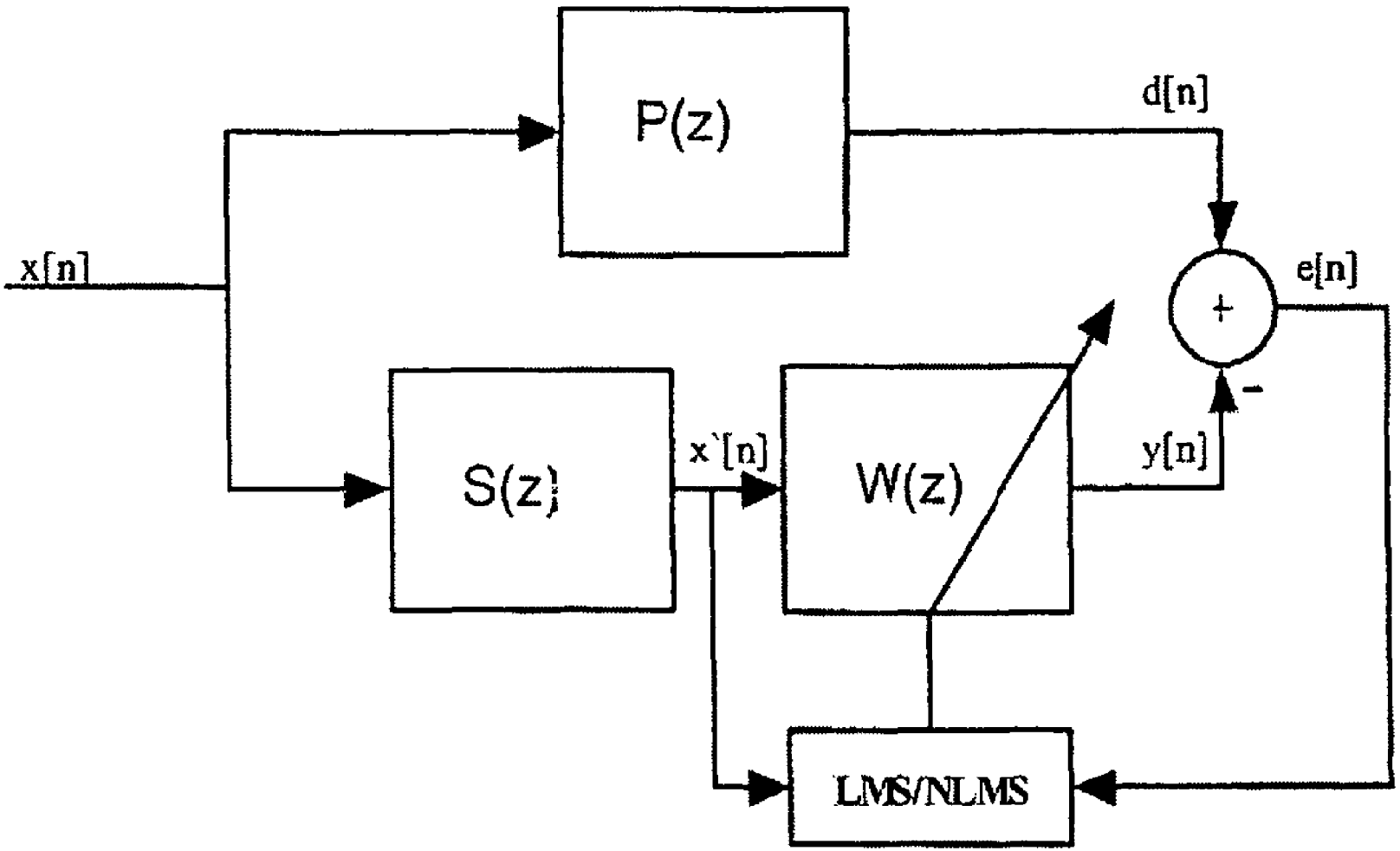
FIG. 1 is a schematic of inversion logic.

In the following, an approximate inversion may be determined using FXLMS (filtered X least mean square) or FXNLMS (filtered X normalized least mean square) logic. FIG. 1 is a schematic of an FXLMS or FXNLMS logic. The error signal e[n] at time n is calculated according to $$\begin{aligned} e[n] &= d[n] - y[n] \\ &= (p^T[n]x[n]) - (w^T[n]x^f[n]) \\ &= (p^T[n]x[n]) - (w^T[n](s^T[n]x[n])) \end{aligned}$$

with the input signal vector $$x[n]=[x[n],x[n-1], \ldots x[n-L+1]]^T$$

where L denotes the filter length of the inverse filter W(z). The filter coefficient vector of the inverse filter has the form $$w[n]=[w_0,[n],w_1[n], \ldots ,W_{L-1}[n]]^T,$$

the filter coefficient vector of the reference transfer function P(z)

$$p[n]=[p_0[n], \ldots, p_{L-}[n]]^T$$

and the filter coefficient vector of the n-th microphone transfer function S(z)

$$s[n]=[s_0[n], s_1[n], \ldots, s_{L-}1[n]]^T.$$

The update of the filter coefficients of w[n] may be performed iteratively (e.g., at each time step n) where the filter coefficient w[n] are computed such that the instantaneous squared error $e^2[n]$ is minimized. This can be achieved, for example, by using the LMS algorithm:

$$w[n+1]=w[n]+\mu x'[n]e[n]$$

or by using the NLMS algorithm $$w[n+1] = w[n] + \frac{\mu}{x'[n]^T x'[n]} x'[n]e[n]$$

where μ characterizes the adaptation steps and $$x'[n]=[x'[n], x'[n-1], \ldots, x'[n-L+1]]^T$$

denotes the input signal vector filtered by S(z).

In some systems, the susceptibility increases with decreasing frequency. Thus, it is preferred to adjust the microphone transfer functions depending on frequency, in particular, with a high precision for low frequencies. To achieve a high precision of the inverse filters, such as a Finite Impulse Response (FIR) filters, the filters may be very long to obtain a sufficient frequency resolution in a desired frequency range. This means that the memory requirements may increase rapidly. However, when using a reduced sampling frequency, such as $f_a$=8 kHz or $f_a \cong 8$ kHz, the computing time may not impose a severe memory limitation. A suitable frequency dependent adaptation of the transfer functions may be achieved by using short WFIR filters (warped FIR filters).

FIG. 2 is a schematic of superdirective beamformer using frequency domain filters which may be included in a hands-free communication system. In FIG. 2, an array of input devices 1 are spaced apart from one another. Each input device 1 may receive a direct or indirect input signal and may output a signal $x_i(t)$. The input devices I may receive a sound wave or energy representing a voiced or unvoiced input and may convert this input into electrical or optical energy. Each input device 1 may be a microphone and may include an internal or external analog-to-digital converter. Beamsteering logic 20 may receive the $x_i(t)$ signals. The signals $x_i(t)$ may be scaled and/or otherwise transformed between the time and/or the frequency domain through the use of one or more transform functions. In FIG. 2, a fast Fourier transform (FFT) 2, transforms the signals $x_i(t)$ from the time domain into the frequency domain and produces signals $X_i(\omega)$. The beamsteering logic 20 may compensate for the propagation time of the different signals received by input devices 1. The beamsteering may be performed by a steering vector $$d(\omega) = \lfloor a_0 e^{-j2\pi f \tau_0}, a_1 e^{-j2\pi f \tau_i}, \ldots, a_{M-1} e^{-j2\pi f \tau_{M-1}} \rfloor,$$

with $$a_n = \frac{\|q - p_{ref}\|}{\|q - p_n\|}$$

and $$\tau_n = \frac{\|q - p_{ref}\| - \|q - p_n\|}{c},$$

Where $p_{ref}$, denotes the position of a reference microphone, $p_n$ the position of microphone n, q the position of the source of sound (e.g., an individual generating an acoustic signal), f the frequency, and c the velocity of sound.

A far field condition may exist where the source of the acoustic signal is more than twice as far away from the microphone array as the maximum dimension of the array. In this situation, the coefficients $a_0, a_1 \ldots a_{M-1}$, of the steering vector may be assumed to be $a_0=a_1=\ldots=a_{m-1}=1$, and only a phase factor $e^{j\omega r_k}$ denoted by reference sign 3 is applied to the signals $X_i(\omega)$.

The signals output by the beamsteering logic 20 may be filtered by the filters 4. The filtered signals may be summed, generating a signal Y(ω). An inverse fast Fourier transform (IFFT) may receive the Y(ω) signal and output a signal y[k].

The beamformer of FIG. 2 may be a regularized superdirective beamformer which may use a finite regularization parameter μ. The finite regularization parameter μ may be frequency dependent, and may result in an improved gain of the microphone array compared to a regularized superdirective beamformer that uses a fixed regularization parameter μ. The filter coefficients may be configured through an iterative design process or other methods based on a predetermined susceptibility. Through one design, the filters may be adjusted with respect to the transfer function and the position of each microphone. Additionally, by using a predetermined susceptibility, defective parameters of the microphone array may be taken into account to further improve the associated gain. The susceptibility may be determined as a function of the error in the transfer characteristic of the microphones, the error in the receiving positions, and/or a predetermined maximum deviation in the directional diagram of the microphone array. The time-invariant impulse response of the filters may be determined iteratively only once, such that there is no adaptation of the filter coefficients during operation.

The filters 4 of FIG. 2 may be configured through an iterative process by first setting μ(ω) to a value of 1 or about 1. The transfer functions of the filters $A_i(\omega)$ and the resulting susceptibilities K(ω) may the be determined according to the equations:

$$A_i(\omega) = \frac{(\Gamma(\omega) + \mu I)^{-1} d}{d^T (\Gamma(\omega) + \mu I)^{-1} d}$$

and $$K(\omega) = \frac{1}{WNG(\omega)} = \frac{A(\omega)^H A(\omega)}{|A(\omega)^H d(\omega)|}.$$

If the susceptibility K(ω) is larger than the maximum susceptibility ($K(\omega) > K_{max}(\omega)$), then the value of μ is increased, otherwise, the value of μ is decreased. The transfer functions and susceptibility may then be re-calculated until the susceptibility K(ω) is sufficiently close to the predetermined $K_{max}(\omega)$. The predetermined $K_{max}(\omega)$ may be a user-definable value. The value of the predetermined $K_{max}(\omega)$ may be selected depending on an implementation, desired quality, and/or cost of the filter specification/design. The iteration may be stopped if the value of μ becomes smaller than a lower limit, such as $\mu_{min}=1^{-8}$. Such a termination criterion may be necessary for high frequencies, such as $f \geqq c/(2d_{mic})$.

Alternatively, the filter coefficients $A_i(\omega)$ may be computed in different ways. In one alternative, a fixed parameter μ may be used for all frequencies. A fixed parameter may simplify the computation of the filter coefficients. In some systems, an iterative method may not be used for a real time adaptation of the filter coefficients.

Figure 3:
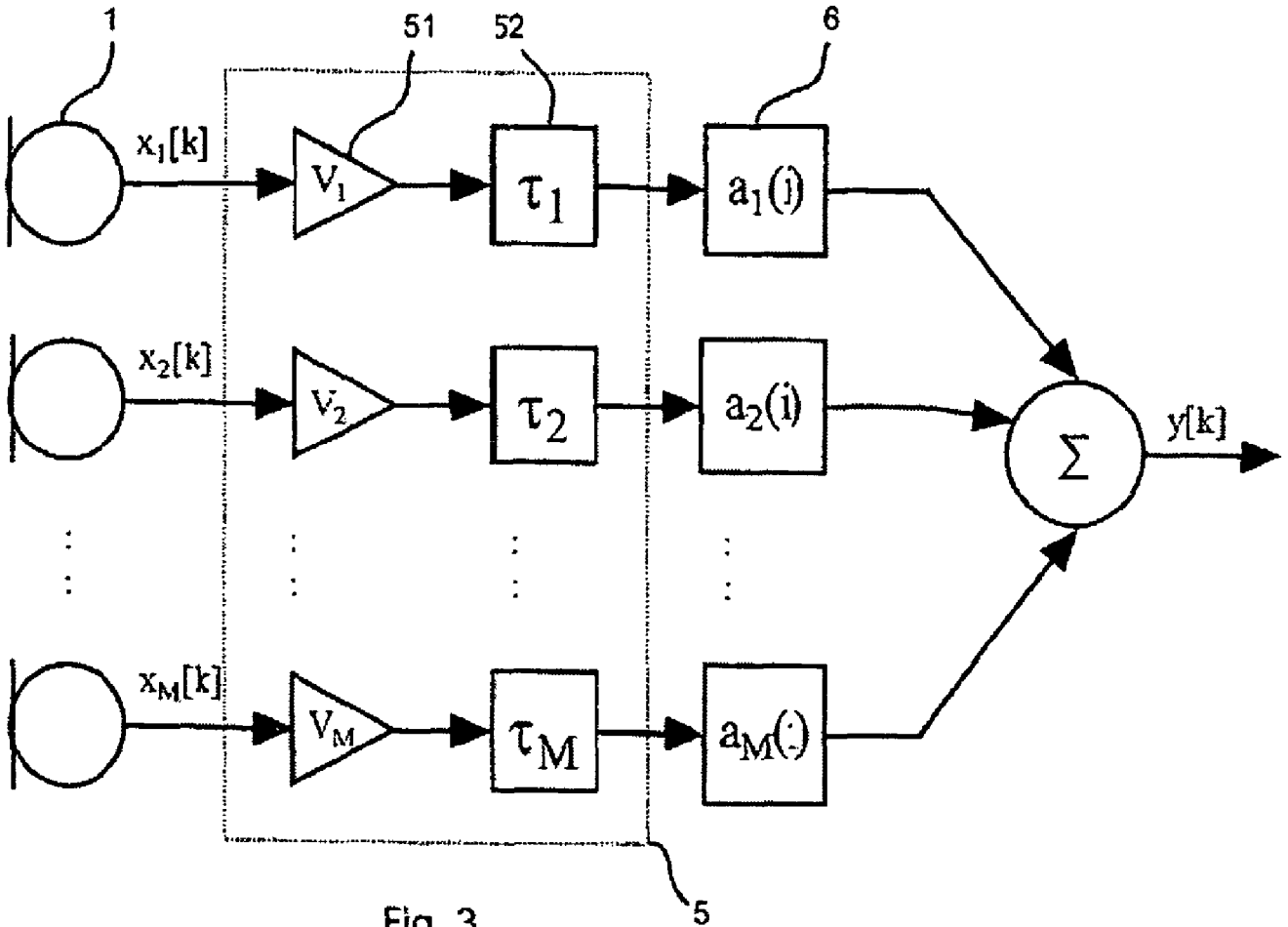
FIG. 3 is a schematic of a beamformer using time domain filters.

Additionally, time domain filters may be used in the handsfree communication system. FIG. 3 is a schematic of a superdirective beamformer using time domain filters. Input signals are received at a plurality of input devices 1 spaced apart from one another. A near field beamsteering 5 is performed using gain factors $V_k$ 51 to compensate for the amplitude differences and time delays $\tau_k$ 52 to compensate for the transit time differences of the microphone signals $x_k[i]$, where $1 \leqq k \leqq M$. The superdirective beamforming may be achieved using filters $a_k(i)$ identified by reference sign 6, where $1 \leqq k \leqq M$.

The values of $a_k(i)$ may be computed by first determining the frequency responses $A_i(\omega)$ according to the above equation. The frequency responses above half of the sampling frequency ($A_i(\omega)=A^*_i(\omega_A-\omega)$) may then be selected, where $\omega_A$ denotes the sampling angular frequency. These frequency responses may then be transferred to the time domain using an Inverse Fast Fourier Transform (IFFT) which generates the desired filter coefficients $a_1(i), \ldots, a_M(i)$. A window function may then be applied to the filter coefficients $a_1(i), \ldots, a_M(i)$. The window function may be a Hamming window.

In FIG. 3, in contrast to the beamforming in the frequency domain, the microphone signals are directly processed using the beamsteering 5 in the time domain. The beamsteering 5 is followed by the filters 6, which may be FIR filters. After summing the filtered signals, a resulting enhanced signal y[k] is obtained.

Depending on the distance between the sound source and the microphone array ($d_{mic}$), and on the sampling frequency $f_a$, more or less propagation or transit time between the microphone signals may be applied. According to the following equation:

$$\Delta_{max} = \frac{d_{mic} f_a}{c},$$

the higher the sampling frequency $f_a$ or the greater the distance between adjacent microphones, the larger the transit time $\Delta_{max}$ (in taps of delay) that is compensated for. The number of taps may also increase if the distance between the sound source and the microphone array is decreased. In the near field, more transit time is compensated for than in the far field. Additionally, an array of microphones in an endfire orientation (e.g., where the microphones are collinear or substantially co-linear with a target direction) is less sensitive to a defective transit time compensation $\Delta_{max}$ than an array in broad-side orientation.

A device or structure that transports persons and/or things such as a vehicle may include a handsfree communication device. In a vehicle, the average distance between a sound source, such as a speaking individual's head, and a microphone array of the handsfree communication device may be about 50 cm. Because the person may move his/her head, this distance may change by about +/−20 cm. If a transit time error of about 1 tap is acceptable, the distance between the microphones in a broad-side orientation with a sampling frequency of $f_a$=8 kHz or $f_a \cong 8$ kHz should be smaller than about $d_{mic_max}$ (broad-side)=5 cm or $d_{mic_max}$ (broad-side)≅5 cm. With the same conditions, the maximum distance between the microphones in endfire orientation may be about $d_{mic_max}$ (endfire)≅20 cm. Where the distance between the microphones is about 5 cm, an endfire orientation using a sampling frequency of $f_a$=16 kHz or $f_a \cong 16$ kHz may produce sufficient results that may not be possible in a broad-side orientation without the use of adaptive beamsteering. In endfire orientation, the sampling frequency or the distance between the microphones may be chosen much higher than in the broad-side case, thus, resulting in an improved beamforming.

In this context, the larger the distance between the microphones, the sharper the beam, in particular, for low frequencies. A sharper beam at low frequencies increases the gain in this range which may be important for vehicles where the noise is mostly a low frequency noise. However, the larger the microphone distance, the smaller the usable frequency range according to the spatial sampling theorem $$f \leq \frac{c}{2d_{mic}}.$$

A violation of this sampling theorem has the consequence that at higher frequencies, large grating lobes appear. These grating lobes, however, are very narrow and deteriorate the gain only slightly. The maximum microphone distance that may be chosen depends not only on the lower limiting frequency for the optimization of the directional characteristic, but also on the number of microphones and on the distance of the microphone array to the speaker. In general, the larger the number of microphones, the smaller their maximum distance in order to optimize the Signal-To-Noise-Ratio (SNR). For a distance between the microphone array and speaker of about 50 cm, the microphone distance, may be about $d_{mic}$=40 cm with two microphones (M=2) and may be about $d_{mic}$=20 cm for M=4. Alternatively, a further improvement of the directivity, and, thus, of the gain, may be achieved by using unidirectional microphones instead of omnidirectional microphones.

Figure 4:
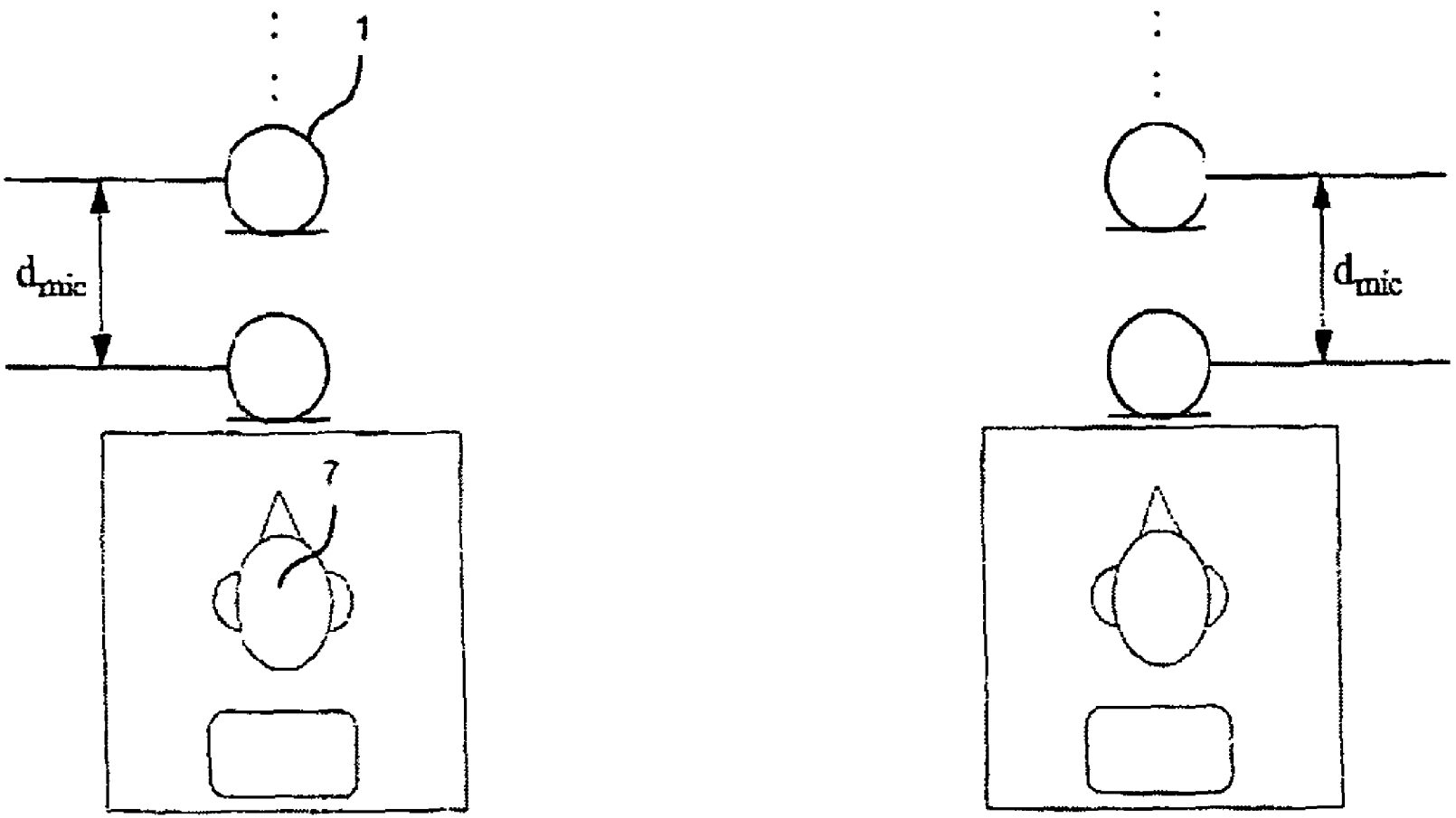
FIG. 4 is a microphone array arrangement in a vehicle.
Figure 5:
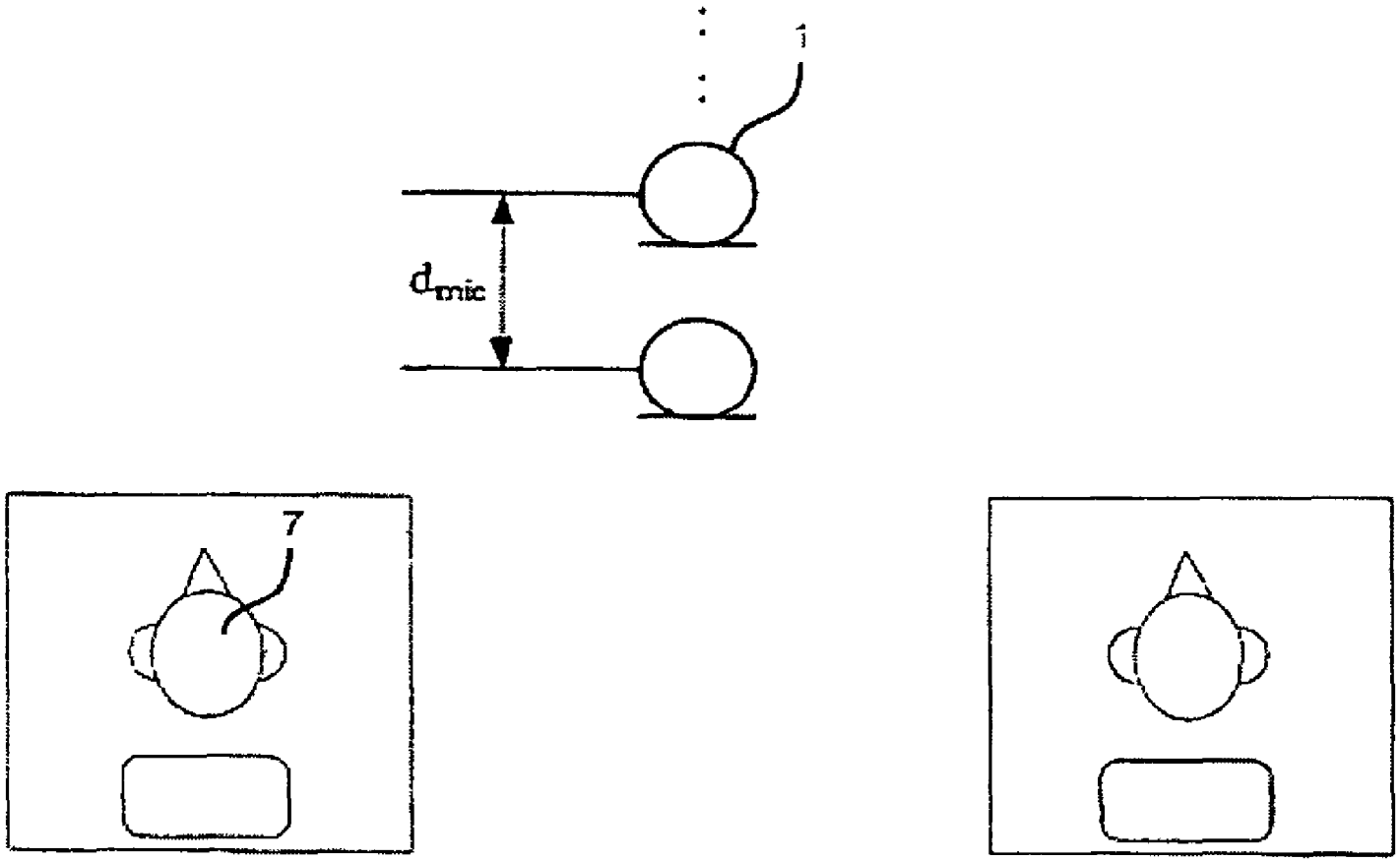
FIG. 5 is an alternate microphone arrangement in a vehicle.

FIGS. 4 and 5 are microphone array arrangements in a vehicle. The distance between the microphone array and the sound source (e.g., speaking individual) should be as small as possible. In FIG. 4, each speaker 7 may have its own microphone array comprising at least two microphones 1. The microphone arrays may be provided at different locations, such as within the vehicle headliner, dashboard, pillar, headrest, steering wheel, compartment door, visor, rearview mirror, or anywhere in an interior of a vehicle. An arrangement within the roof may also be used; however, this case may not always be suitable in a vehicle with a convertible top. Both microphone arrays may be configured in an endfire orientation.

Alternatively, in FIG. 5, one microphone array may be used for two neighboring speakers. In the configurations of both FIGS. 4 and 5, directional microphones may be used in the microphone arrays. The directional microphones may have a cardioid, hypercardioid, or other directional characteristic pattern.

In FIG. 5, the microphone array may be mounted in a vehicle's rearview mirror. Such a linear microphone array may be used for both the driver and the front seat passenger. By mounting the microphone array in the rearview mirror, the cost of mounting the microphone array in the roof may be avoided. Furthermore, the array can be mounted in one piece, which may provide increased precision. Additionally, due to the placement of the mirror, the array may be positioned according to a predetermined orientation.

Figure 6:
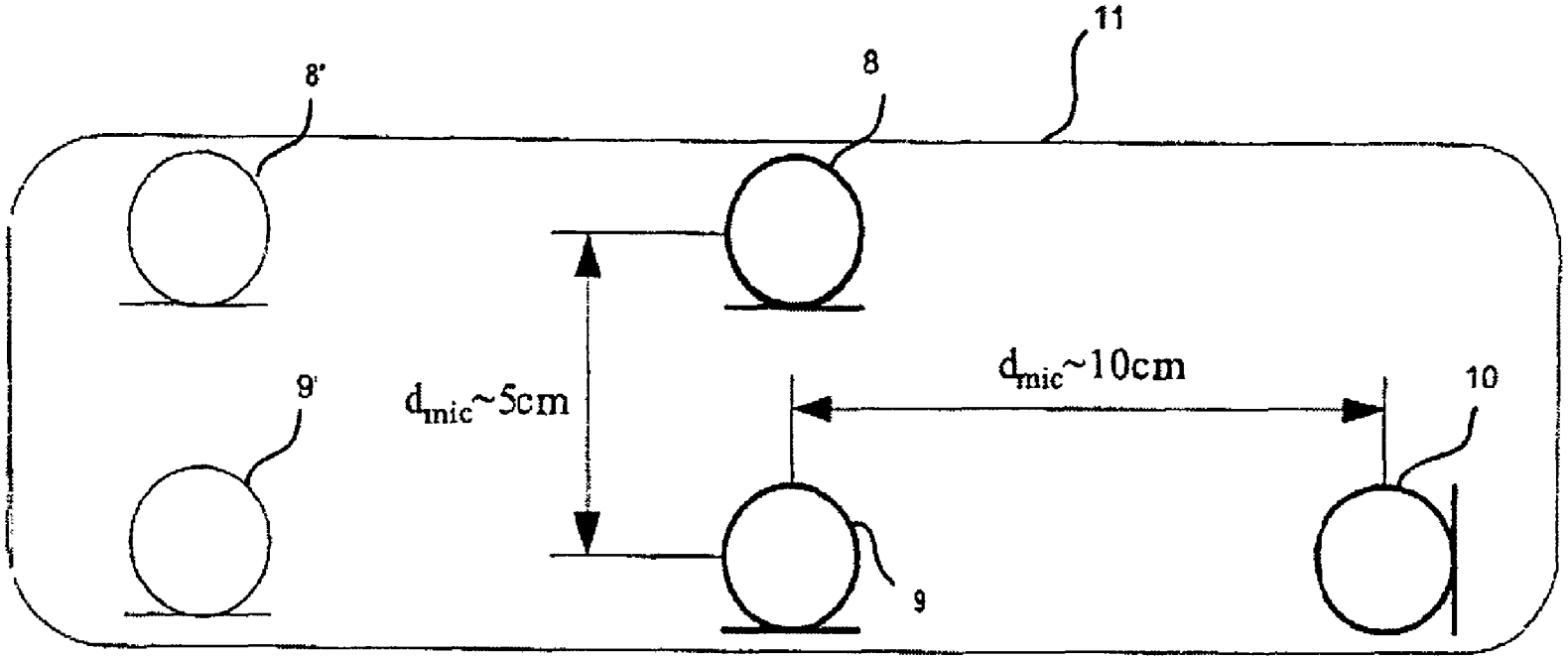
FIG. 6 is a top view of a microphone arrangement in a rearview mirror.

FIG. 6 is a top view of a vehicle rearview mirror 11. The rearview mirror 11 may have a frame in which microphones are positioned in or on. In FIG. 6 three microphones are positioned in two alternative arrangements in or on the frame of the rearview mirror. A first arrangement includes two microphones 8 and 9 which are located in the center of the mirror and which may be in an endfire orientation with respect to the driver. Microphones 8 and 9 are spaced apart from one another by a distance of about 5 cm. The microphones 9 and 10 may be in an endfire orientation with respect to the front seat passenger. Microphones 9 and 10 may be spaced apart from one another by a distance of about 10 cm. Since the microphone 9 is used for both arrays, a cheap handsfree system may be provided.

All three microphones may be directional microphones. The microphones 8, 9, and 10 may have a cardioid, hypercardioid, or other directive characteristic pattern. Additionally, some or all of the microphones 8, 9, and 10 may be directed towards the driver. Alternatively, microphones 8 and 10 may be directional microphones, while microphone 9 may be an omnidirectional microphone. This configuration may further reduce the cost of the handsfree communication system. Due to the larger distance between microphones 9 and 10 as compared to the distance between microphones 8 and 9, the front seat passenger beamformer may have a better signal-to-noise ration (SNR) at low frequencies as compared to the driver beamformer.

Alternatively, the microphone array for the driver may consist of microphones 8' and 9' located at the side of the mirror. In this case, the distance between this microphone array and the driver may be increased which may decrease the performance of the beamformer. On the other hand, the distance between microphone 9' and 10 would be about 20 cm, which may produce a better gain for the front seat passenger at low frequencies.

Figure 7:
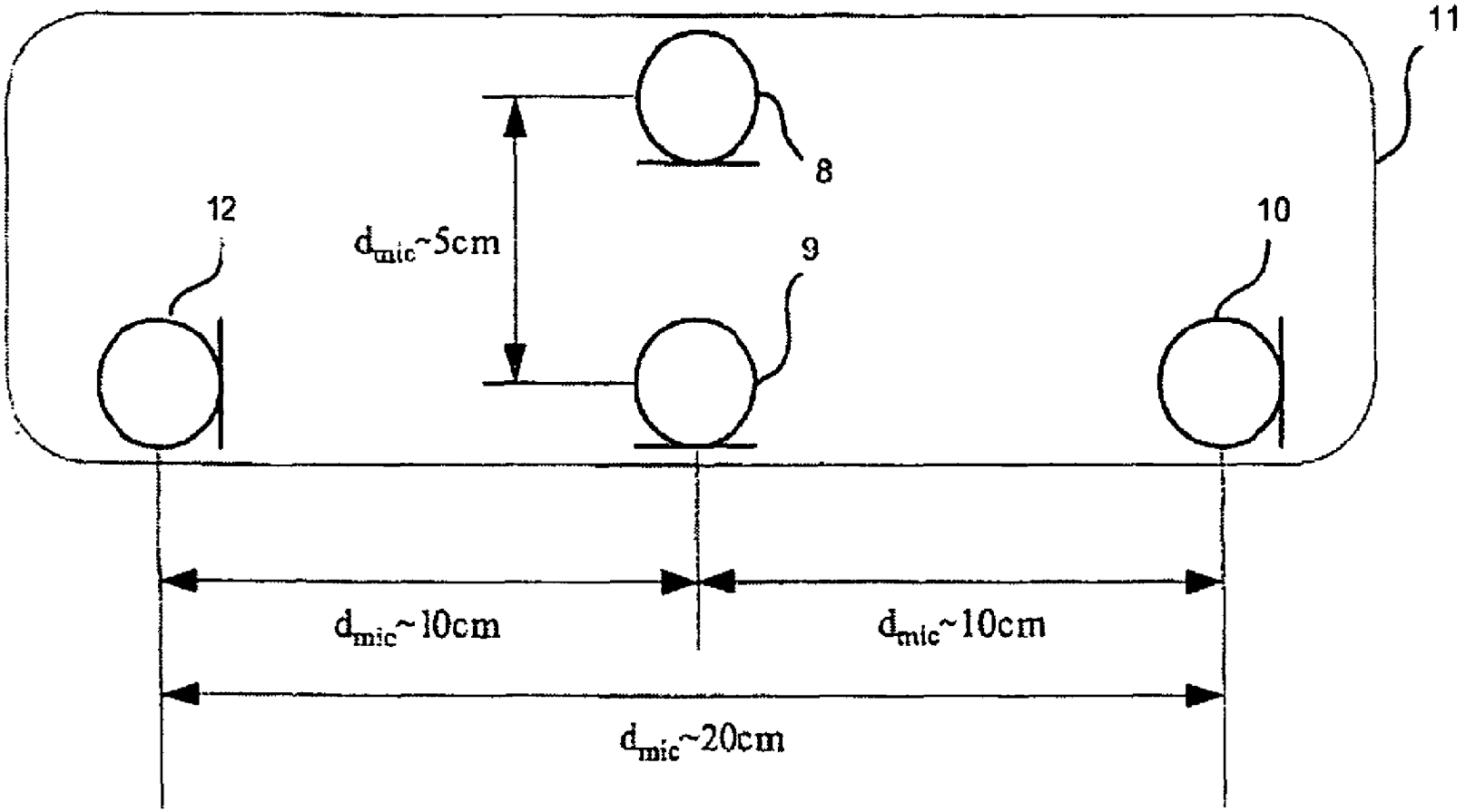
FIG. 7 is an alternate top view of a microphone arrangement in a rearview mirror.

FIG. 7 is another alternative configuration of a microphone array mounted in or on a frame of a vehicle rearview mirror 11. In FIG. 7, all of the microphones may be directional microphones. Microphones 8 and 9 may be directed to the driver while microphones 10 and 12 may be directed to a front seat passenger. To increase the gain of the front seat passenger, the microphone array of the front seat passenger may include microphones 9, 10, and 12. Depending on the arrangement of a vehicle passenger cabin, more or less microphones and/or other microphone configurations may be used. Alternatively, a microphone array may be mounted in or on other types of frames within an interior of a vehicle, such as the dashboard frame, a visor frame, and/or a stereo/infotainment frame.

Figure 8:
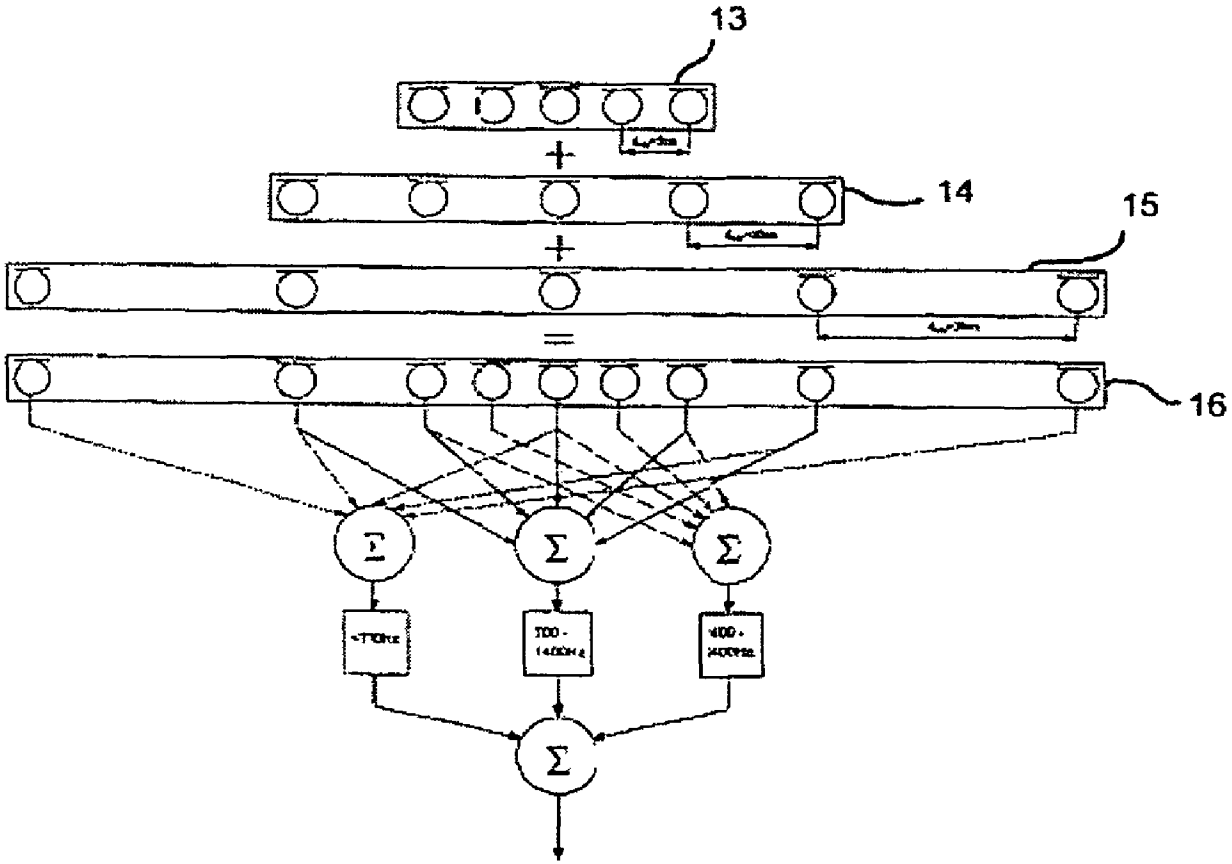
FIG. 8 is a microphone array including three subarrays.

FIG. 8 is a microphone array comprising three subarrays 13, 14, and 15. In FIG. 8, each subarray includes five microphones. However, more or less microphones may be used. Within each subarray 13, 14 , and 15, the microphones are equally spaced apart. In the total array 16, the distances between the microphones are no longer equal. Some microphones may not be used in certain configurations. Accordingly, in FIG. 8, only 9 microphones are needed to implement the total array 16 as opposed to 15 microphones ((5 microphones/array)×(3 arrays)).

In FIG. 8, the different subarrays may be used for different frequency ranges. The resulting directional diagram may be constructed from the directional diagrams of each subarray for a respective frequency range. In FIG. 6, subarray 13 with $d_{mic}$=5 cm or $d_{mic}$≅5 cm may be used for the frequency band of about 1400-3400 Hz, subarray 14 with $d_{mic}$=10 cm $d_{mic}$≅10 cm may be used for the frequency band of about 700-1400 Hz, and subarray 15 with $d_{mic}$=20 cm or $d_{mic}$≅20 cm may be used for the band of frequencies smaller than about 700 Hz. Alternatively, a lower limit of about 300 Hz may be used. This frequency may be the lowest frequency of the telephone band.

Figure 9:
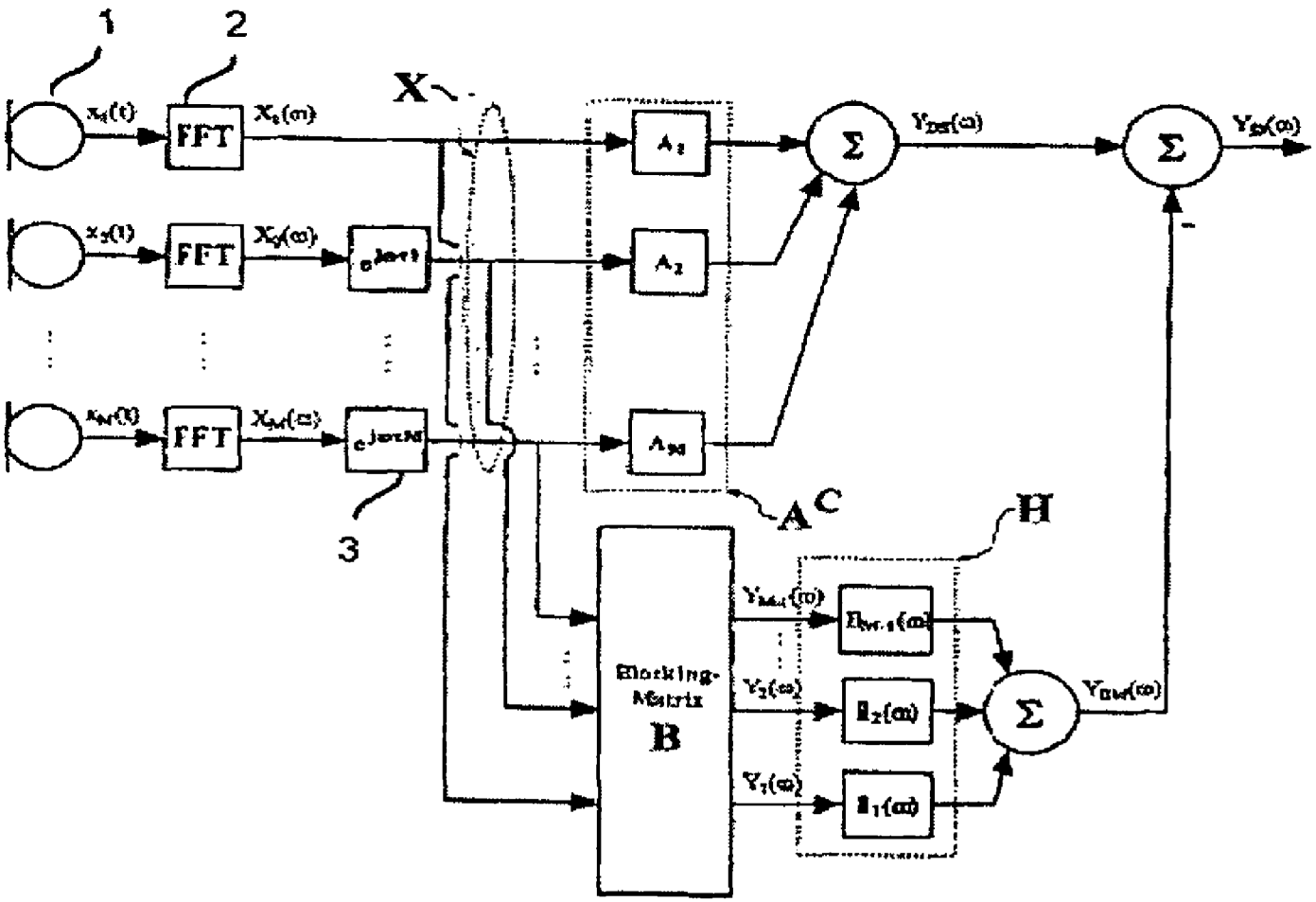
FIG. 9 is a schematic of a beamformer in a general sidelobe canceller configuration.

An improved directional characteristic may be obtained if the superdirective beamformer is designed as general sidelobe canceller (GSC). In a GSC, the number of filters may be reduced. FIG. 9 is a schematic of a superdirective beamformer in a GSC configuration. The GSC configuration may be implemented in the frequency domain. Therefore, a FFT 2 may be applied to the incoming signals $x_k(t)$. Before the general sidelobe cancelling, a time alignment using phase factors $e^{j\omega r_k}$ is performed. In FIG. 7, a far field beamsteering is shown since the phase factors have a coefficient of 1. In some configurations, the phase factor coefficients may be values other than 1.

In FIG. 9, X denotes all time aligned input signals $X_i(\omega)$. $A^c$ denotes all frequency independent filter transfer functions $A_i$ that are necessary to observe the constraints in a viewing direction. H denotes the transfer functions performing the actual superdirectivity. B is a blocking matrix that projects the input signals in X onto a"noise plane". The signal $Y_{DS}(\omega)$ denotes the output signal of a delay and sum beamformer. The signal $Y_{BM}(\omega)$ denotes the output signal of the blocking branch. The signal $Y_{SD}(\omega)$ denotes the output signal of the superdirective beamformer. The input signals in the time and frequency domain, respectively, that are not yet time aligned are denoted by $x_i(t)$ and $X_i(\omega)$. $Y_i(\omega)$ represents the output signals of the blocking matrix that ideally should block completely the desired or useful signal within the input signals. The signals $Y_i(\omega)$ ideally only comprise the noise signals. The number of filters that may be saved using the GSC depends on the choice of the blocking matrix. A Walsh-Hadamard blocking matrix may be used with the GSC configuration. However, the Walsh-Hadamard blocking matrix may only be used for arrays consisting of $M=2^n$ microphones. Alternatively, a Griffiths-Jim blocking matrix may be used.

A blocking matrix may have the following properties:

1. It is a (M−1)×(M) Matrix.
2. The sum of the values within one row is zero.
3. The matrix is of rank M−1.

A Walsh-Hadamard blocking matrix for n=2 (e.g., $M=2^2=4$) may have the following form $$B=\begin{bmatrix}1 & 1 & -1 & -1\\ 1 & -1 & -1 & 1\\ 1 & -1 & 1 & -1\end{bmatrix}$$

A blocking matrix according to Griffiths-Jim may have the general form $$B=\begin{bmatrix}1 & -1 & 0 & \dots & 0\\ 0 & 1 & -1 & \dots & 0\\ \vdots & & \ddots & \ddots & \vdots\\ 0 & 0 & \dots & 1 & -1\end{bmatrix}$$

The upper branch of the GSC structure is a delay and sum beamformer with the transfer functions $$A^C=\left[\underbrace{\frac{1}{M},\frac{1}{M},\dots,\frac{1}{M}}_{M}\right]^T.$$

The computation of the filter coefficients of a superdirective beamformer in GSC structure is slightly different compared to the conventional superdirective beamformer. The transfer functions $H_i(\omega)$ may be computed as $$H_i(\omega)=(B\Phi_{NN}(\omega)B^H)^{31\ 1}(B\Phi_{NN}(\omega)A^C),$$

where B is the blocking matrix and $\Phi_{NN}(\omega)$ is the matrix of the cross-correlation power spectrum of the noise. In the case of a homogenous noise field, $\Phi_{NN}(\omega)$ can be replaced by the time aligned coherence matrix of the diffuse noise field $\Gamma(\omega)$, as previously discussed. A regularization and iterative design with predetermined susceptibility may be performed as previously discussed.

Figure 10:
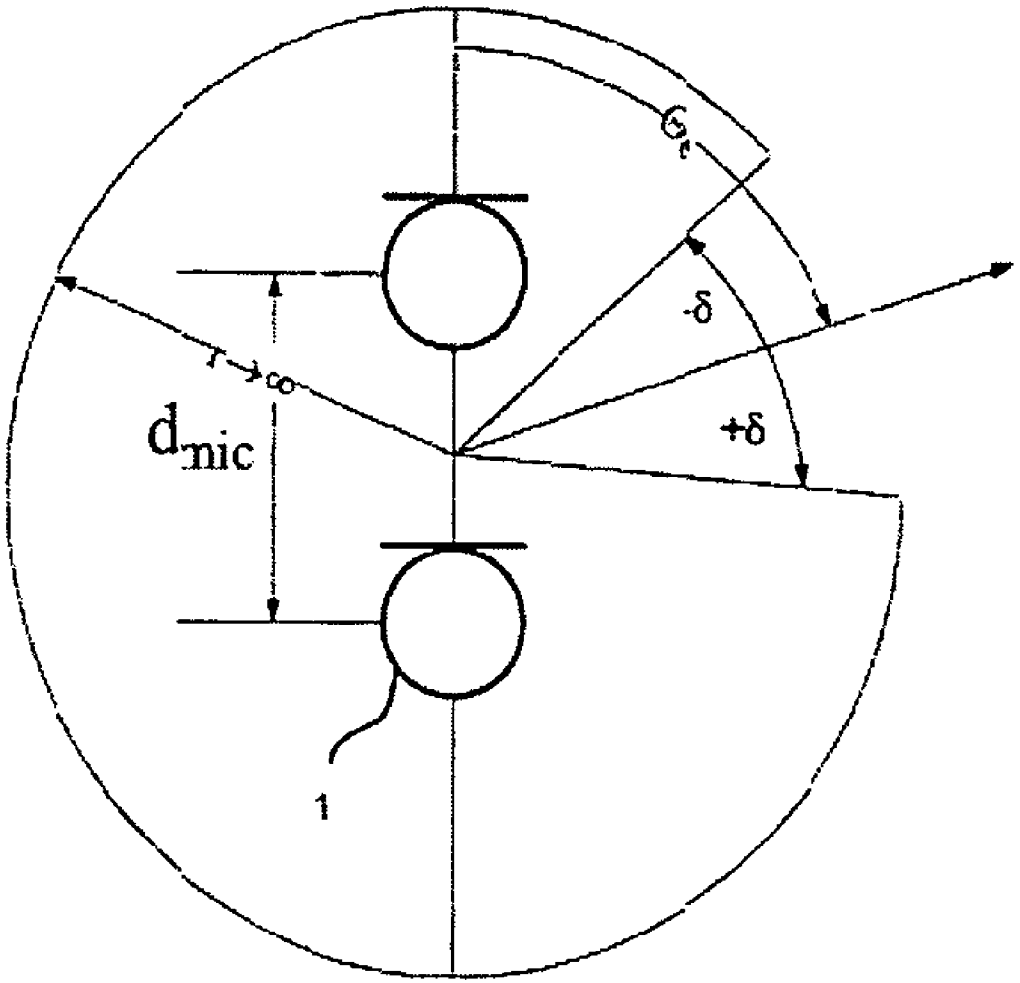
FIG. 10 is a schematic of a non-homogenous sound field.

Some filter designs assume that the noise field is homogenous and diffuse. These designs may be generalized by excluding a region around the main receiving direction $\Theta_0$ when determining the homogenous noise field. In this way, the Front-To-Back-Ratio may be optimized. In FIG. 10, a sector of +/−δ is excluded. The computation of the two-dimensional diffuse (cylindrically isotropic) homogenous noise field may be performed using the design parameter δ, which may represent the azimuth, in the coherence matrix:

$$\Gamma(\omega, \Theta_0, \delta) = \frac{1}{2(\pi-\delta)}\int_{\Theta_0+\varepsilon}^{\Theta_0-\delta+2\pi} e^{j\left(\frac{2\pi f d_{ij}\cos\Theta}{c}\right)} d\Theta e^{-j\left(\frac{2\pi f d_{ij}\cos\Theta_0}{c}\right)}, \quad i, j\varepsilon[1, \ldots, M]$$

This method may also be generalized to the three-dimensional case. In this situation, a parameter p may be introduced to represent an elevation angle. This produces an analog equation for the coherence of the homogeneous diffuse 3D noise field.

A superdirective beamformer based on an isotropic noise field is useful for an after market handsfree system which may be installed in a vehicle. A Minimum Variance Distortionless Response (MVDR) beamformer may be useful if there are specific noise sources at fixed relative positions or directions with respect to the position of the microphone array. In this use, the handsfree system may be adapted to a particular vehicle cabin by adjusting the beamformer such that its zeros point in the direction of the specific noise sources. These specific noise sources may be formed by a loudspeaker or a fan. A handsfree system with a MVDR beamformer may be installed during the manufacture of the vehicle or provided as an aftermarket system.

A distribution of noise or noise sources in a particular vehicle cabin may be determined by performing corresponding noise measurements under appropriate conditions (e.g., driving noise with and/or without a loudspeaker and/or a fan noise). The measured data may be used for the design of the beamformer. In some designs, further adaptation is not performed during operation of the handsfree system. Alternatively, if the relative position of a noise source is known, the corresponding superdirective filter coefficients may be determined theoretically.

Figure 11:
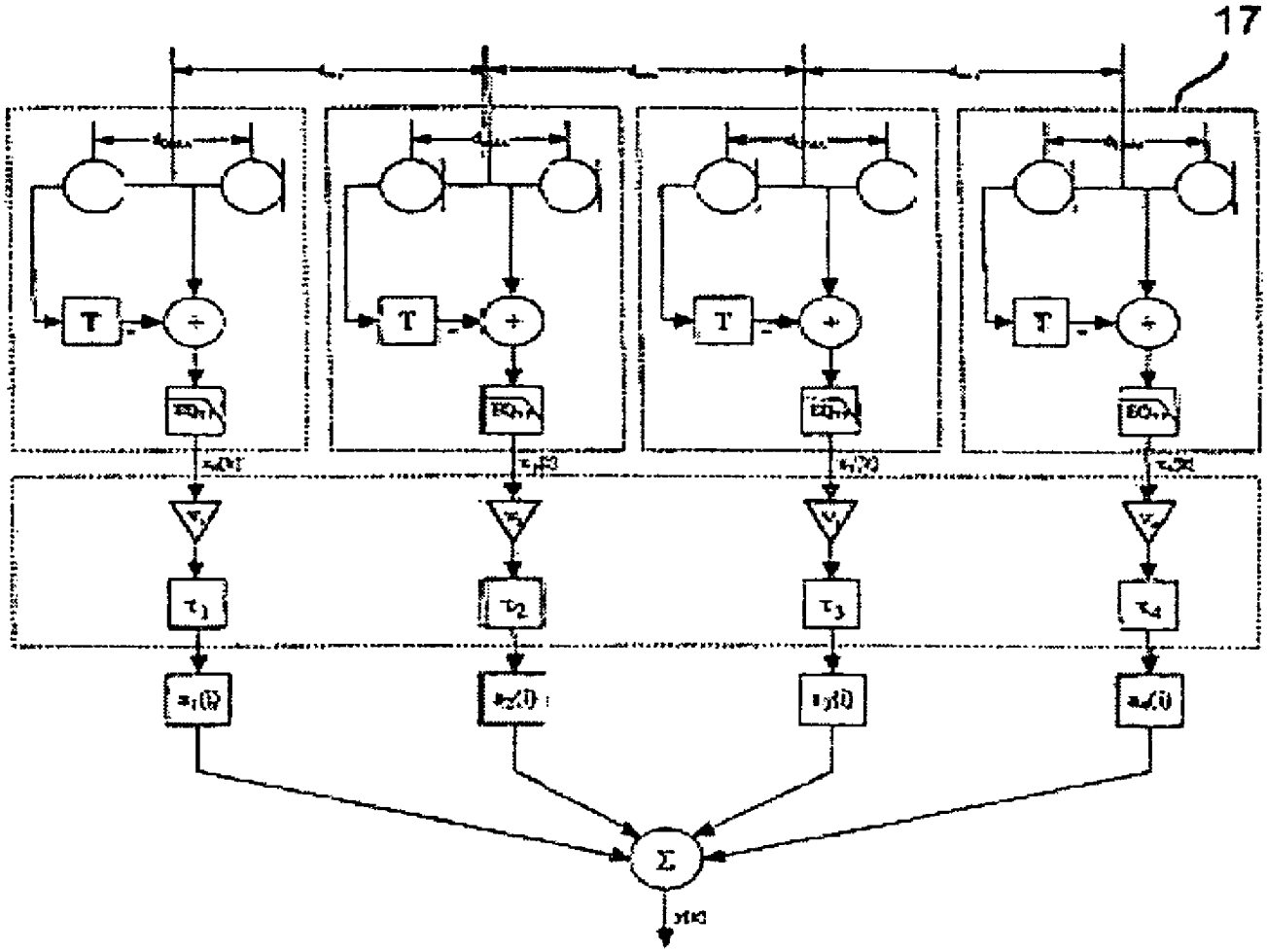
FIG. 11 is a schematic of a beamformer with directional microphones.

FIG. 11 is a schematic of a superdirective beamformer with directional microphones 17. In FIG. 11, each directional microphone 17 is depicted by an equivalent circuit diagram. In these circuit diagrams, $d_{DMA}$ denotes the (virtual) distance of the two omnidirectional microphones composing the first order pressure gradient microphone in the circuit diagram. T is the (acoustic) delay line fixing the characteristic of the directional microphone, and $EQ_{TP}$ is the equalizing low path filter that produces a frequency independent transfer behavior in a viewing direction.

In practice, these circuits and filters may be realized purely mechanically by taking an appropriate mechanical directional microphone. Again, the distance between the directional microphones is $d_{mic}$. In FIG. 11, the whole beamforming is performed in the time domain. A near field beamsteering is applied to the signals $x_n[i]$ output by the microphones 17. The gain factors $v_n$ compensate for the amplitude differences, and the delays $\tau_n$ compensate for the transit time differences of the signals. FIR filters $a_n[i]$ realize the superdirectivity in the time domain.

Mechanical pressure gradient microphones have a high quality and produce a high gain when the microphones have a hypercardioid characteristic pattern. The use of directional microphones may also result in a high Front-to-Back-Ratio.

Figure 12:
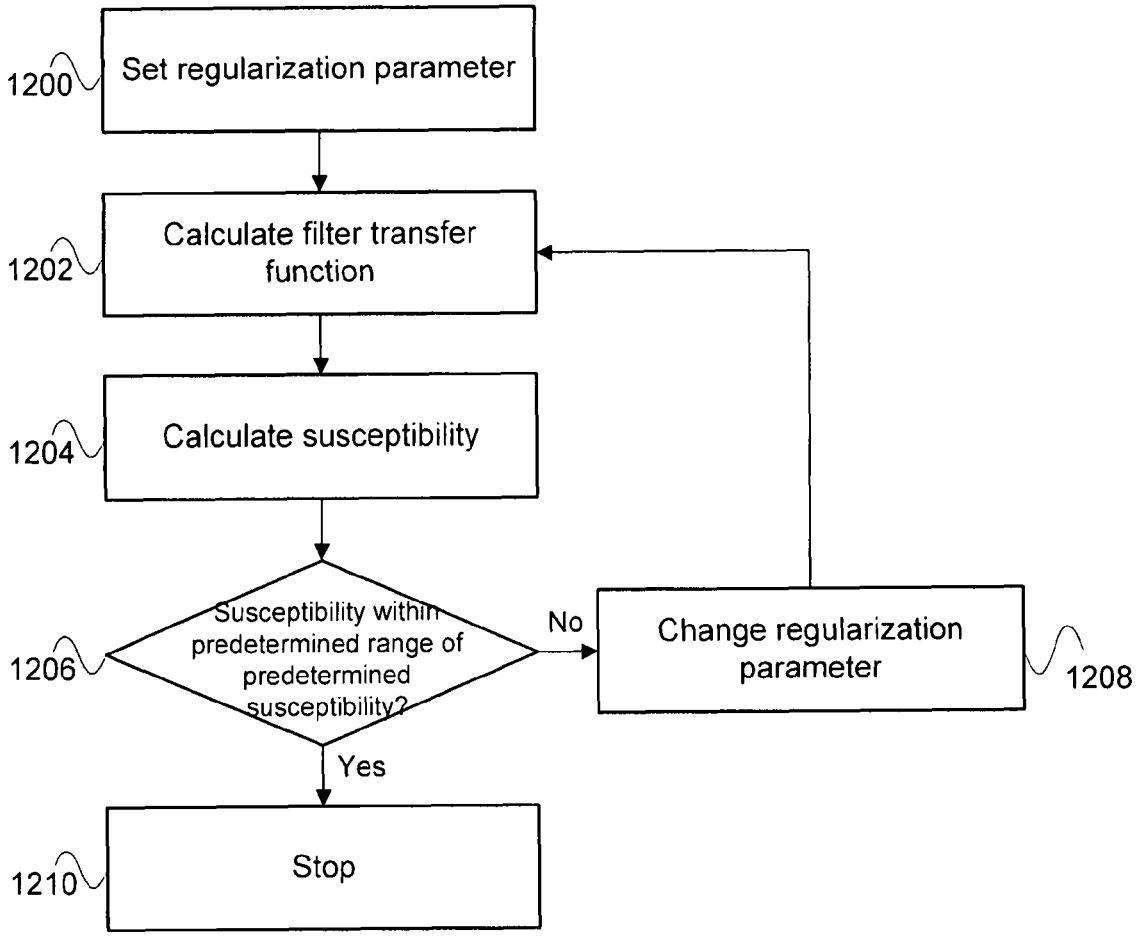
FIG. 12 is a flow diagram to design a superdirective beamformer filter in the frequency domain based on a predetermined susceptibility.

FIG. 12 is a flow diagram to design a superdirective beamformer filter in the frequency domain based on a predetermined susceptibility. At act 1200, a regularization parameter, such as μ, may be set to an initial value. In some designs, the initial value may be 1 or about 1, although other values may be used. At act 1202, a filter transfer function based on the regularization parameter may be calculated. The filter transfer function may be calculated according to $$A_i(\omega) = \frac{(\Gamma(\omega)+\mu I)^{-1}d}{d^T(\Gamma(\omega)+\mu I)^{-1}d}.$$

The filter transfer function determined at act 1202 may be used at act 1204 to calculate a susceptibility. The susceptibility may be calculated according to $$K(\omega) = \frac{1}{WNG(\omega)} = \frac{A(\omega)^H A(\omega)}{|A(\omega)^H d(\omega)|},$$

where H denotes Hermitian transposing. At act 1206 it is determined whether the calculated susceptibility is within a predetermined range of a predetermined susceptibility. The predetermined range may be a user-definable range which may vary depending on an implementation, desired quality, and/or cost of the filter specification/design. If the susceptibility is not within the predetermined range of the susceptibility, the regularization parameter may be changed at act 1208. If the susceptibility exceeds the predetermined susceptibility, then the value of the regularization parameter may be increased, otherwise, the value of the regularization parameter may be decreased. The filter transfer function and the susceptibility may then be re-calculated at acts 1202 and 1204, respectively. The design may stop at act 1210 when the susceptibility is within the predetermined range of the predetermined susceptibility.

Figure 13:
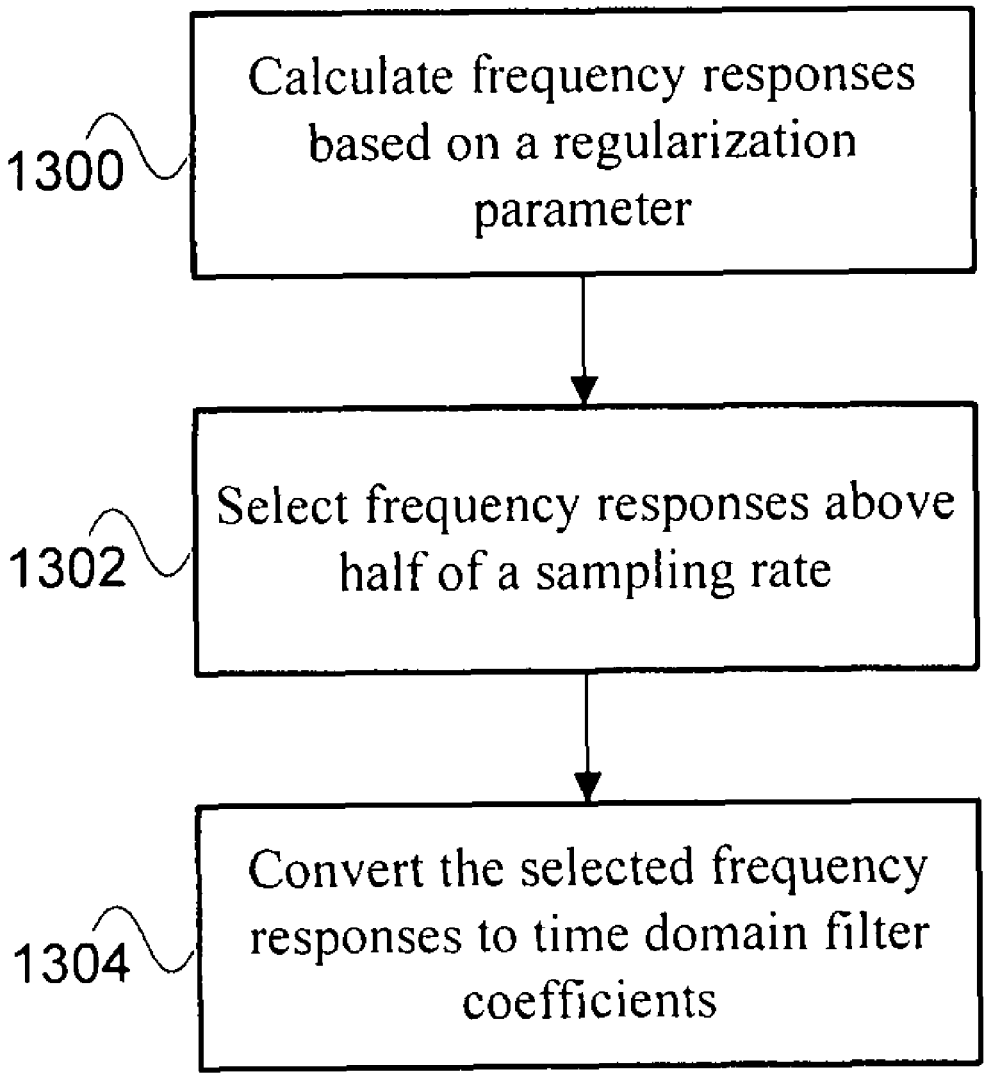
FIG. 13 is a flow diagram to configure a superdirective beamformer filter in the time domain bases on a predetermined susceptibility.

FIG. 13 is a flow diagram to configure a superdirective beamformer filter in the time domain bases on a predetermined susceptibility. At act 1300 frequency responses for a superdirective beamformer filter are calculated based on a regularization parameter. In some systems, the frequency responses may be calculated as shown in FIG. 12. Alternatively, other processes may be used to calculate the frequency responses. At act 1302, the frequency responses above half of a sampling frequency are selected. At act 1304, the selected frequency responses are converted to time domain filter coefficients.

These processes, as well as others described above, may be encoded in a computer readable medium such as a memory, programmed within a device such as one or more integrated circuits, one or more processors or may be processed by a controller or a computer. If the processes are performed by software, the software may reside in a memory resident to or interfaced to a storage device, a communication interface, or non-volatile or volatile memory in communication with a transmitter. The memory may include an ordered listing of executable instructions for implementing logical functions. A logical function or any system element described may be implemented through optic circuitry, digital circuitry, through source code, through analog circuitry, or through an analog source, such as through an electrical, audio, or video signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or"signal-bearing medium" may comprise any device that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory"RAM" (electronic), a Read-Only Memory"ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

Although selected aspects, features, or components of the implementations are depicted as being stored in memories, all or part of the systems, including processes and/or instructions for performing processes, consistent with the system may be stored on, distributed across, or read from other machine-readable media, for example, secondary storage devices such as hard disks, floppy disks, and CD-ROMs; a signal received from a network; or other forms of ROM or RAM, some of which may be written to and read from in a vehicle.

Specific components of a system may include additional or different components. A controller may be implemented as a microprocessor, microcontroller, application specific integrated circuit (ASIC), discrete logic, or a combination of other types of circuits or logic. Similarly, memories may be DRAM, SRAM, Flash, or other types of memory. Parameters (e.g., conditions), databases, and other data structures may be separately stored and managed, may be incorporated into a single memory or database, or may be logically and physically organized in many different ways. Programs and instruction sets may be parts of a single program, separate programs, or distributed across several memories and processors.

Some handsfree communication systems may include one or more arrays comprising devices that convert sound waves into electrical signals. Additionally, other communication systems may include one or more arrays comprising devices and/or sensors that respond to a physical stimulus, such as sound, pressure, and/or temperature, and transmit a resulting impulse.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A method to design a superdirective beamformer filter in the frequency domain based on a predetermined susceptibility, comprising:

calculating a filter transfer function based on a regularization parameter;

calculating a susceptibility based on the determined transfer function;

determining if the calculated susceptibility exceeds the predetermined susceptibility;

changing the value of the regularization parameter and re-calculating the filter transfer function and the susceptibility until the susceptibility is within an acceptable range of the predetermined susceptibility; and configuring the superdirective beamformer filter according to the calculated transfer function.

2. The method of claim 1, where the act of calculating a filter transfer function based on the regularization parameter comprises determining $A_i(\omega)$ where $$A_i(\omega) = \frac{(\Gamma(\omega) + \mu I)^{-1} d}{d^T (\Gamma(\omega) + \mu I)^{-1} d}.$$

3. The method of claim 2, where the act of calculating the susceptibility comprises determining $K(\omega)$ where $$K(\omega) = \frac{1}{WNG(\omega)} = \frac{A(\omega)^H A(\omega)}{|A(\omega)^H d(\omega)|}.$$

4. The method of claim 1, where the act of changing the value of the regularization parameter comprises increasing the value of the regularization parameter when the calculated susceptibility exceeds the predetermined susceptibility.

5. The method of claim 1, where the act of changing the value of the regularization parameter comprises decreasing the value of the regularization parameter when the calculated susceptibility is less than the regularization parameter.

* * * * *